US008894179B1

(12) United States Patent
Metcalfe et al.

(10) Patent No.: US 8,894,179 B1
(45) Date of Patent: Nov. 25, 2014

(54) SYSTEM AND METHOD FOR HIGH SPEED INOPERATIVE INKJET COMPENSATION

(71) Applicant: Xerox Corporation, Norwalk, CT (US)

(72) Inventors: David J. Metcalfe, Marion, NY (US); Stephen M. Kroon, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/924,872

(22) Filed: Jun. 24, 2013

(51) Int. Cl.
*B41J 29/393* (2006.01)
*B41J 2/21* (2006.01)
*B41J 2/045* (2006.01)

(52) U.S. Cl.
CPC ..... *B41J 2/2139* (2013.01); *B41J 2/04546* (2013.01); *B41J 2/0451* (2013.01); *B41J 2/04541* (2013.01)
USPC ..... 347/19; 347/14

(58) Field of Classification Search
USPC ..... 347/19, 14
See application file for complete search history.

(56) References Cited

U.S. PATENT DOCUMENTS 6,010,205 A 1/2000 Billet
8,004,714 B2 8/2011 Metcalfe et al.

FOREIGN PATENT DOCUMENTS

EP 1011976 B1 6/2000

OTHER PUBLICATIONS

WO 96/32266 International Application, Detection of Faulty Acutators in Pinting Heads, published Oct. 17, 1996.*

* cited by examiner

*Primary Examiner* — Julian Huffman
*Assistant Examiner* — Sharon A Polk
(74) *Attorney, Agent, or Firm* — Maginot Moore & Beck LLP

(57) ABSTRACT

An apparatus enables a printer to identify neighboring inkjets to compensate for inoperative inkjets with reference to different search patterns. The apparatus includes a plurality of mutliplexers, a memory, a decoder, and a controller. The multiplexers are operatively connected to the memory to receive data that selects one of a plurality of image data pixels on the inputs of the multiplexers. The outputs of the multiplexers are concatenated in a predetermined order and the decoder identifies a highest priority image data pixel available for inoperative inkjet compensation. The controller operates the memory to output the data stored at the plurality of storage locations in a first sequence to enable the multiplexers to output the image data pixels in the predetermined order for the decoder.

13 Claims, 13 Drawing Sheets

150

154

| | \|8\| | \|7\| | \|6\| | \|5\| | \|4\| | \|3\| | \|2\| | \|1\| | \|0\| |
|---|---|---|---|---|---|---|---|---|---|
| \|0\| | 27 | 26 | 25 | 24 | 23 | 22 | 21 | 20 | 19 |
| \|1\| | 18 | 17 | 16 | 15 | 14 | 13 | 12 | 11 | 10 |
| \|2\| | 9 | 8 | 7 | 6 | 5 | 4 | 3 | 2 | 1 |
| | | | | | X | | | | |
| \|4\| | 9 | 8 | 7 | 6 | 5 | 4 | 3 | 2 | 1 |
| \|5\| | 18 | 17 | 16 | 15 | 14 | 13 | 12 | 11 | 10 |
| \|6\| | 27 | 26 | 25 | 24 | 23 | 22 | 21 | 20 | 19 |

158

FIG. 1

170

174

| | \|8\| | \|7\| | \|6\| | \|5\| | \|4\| | \|3\| | \|2\| | \|1\| | \|0\| |
|---|---|---|---|---|---|---|---|---|---|
| \|0\| | 27 | 26 | 25 | 24 | 23 | 22 | 21 | 20 | 19 |
| \|1\| | 18 | 17 | 16 | 15 | 14 | 13 | 12 | 11 | 10 |
| \|2\| | 9 | 8 | 7 | 6 | 5 | 4 | 3 | 2 | 1 |
| | | | | | X | | | | |
| \|4\| | 1 | 2 | 3 | 4 | 5 | 6 | 7 | 8 | 9 |
| \|5\| | 10 | 11 | 12 | 13 | 14 | 15 | 16 | 17 | 18 |
| \|6\| | 19 | 20 | 21 | 22 | 23 | 24 | 25 | 26 | 27 |

178

FIG. 2

FROM FIG. 4A

| ADDRESS | DATA | ADDRESS | DATA | ADDRESS | DATA |
|---|---|---|---|---|---|
| 0 | 5 | 0 | 5 | 0 | 5 |
| 1 | 4 | 1 | 4 | 1 | 6 |
| 2 | 6 | 2 | 6 | 2 | 4 |
| 3 | 3 | 3 | 14 | 3 | 14 |
| 4 | 7 | 4 | 13 | 4 | 15 |
| 5 | 14 | 5 | 15 | 5 | 13 |
| 6 | 13 | 6 | 23 | 6 | 7 |
| 7 | 15 | 7 | 22 | 7 | 3 |
| 8 | 12 | 8 | 24 | 8 | 23 |
| 9 | 16 | 9 | 0 | 9 | 16 |
| 10 | 0 | 10 | 0 | 10 | 12 |
| 11 | 0 | 11 | 0 | 11 | 24 |
| 12 | 0 | 12 | 0 | 12 | 22 |
| 13 | 0 | 13 | 0 | 13 | 8 |
| 14 | 0 | 14 | 0 | 14 | 2 |
| 15 | 0 | 15 | 0 | 15 | 25 |
| 16 | 0 | 16 | 0 | 16 | 21 |
| 17 | 0 | 17 | 0 | 17 | 17 |
| 18 | 0 | 18 | 0 | 18 | 11 |
| 19 | 0 | 19 | 0 | 19 | 26 |
| 20 | 0 | 20 | 0 | 20 | 20 |
| 21 | 0 | 21 | 0 | 21 | 9 |
| 22 | 0 | 22 | 0 | 22 | 1 |
| 23 | 0 | 23 | 0 | 23 | 18 |
| 24 | 0 | 24 | 0 | 24 | 10 |
| 25 | 0 | 25 | 0 | 25 | 27 |
| 26 | 0 | 26 | 0 | 26 | 19 |
| 27 | 0 | 27 | 0 | 27 | 0 |
| 28 | 0 | 28 | 0 | 28 | 0 |
| 29 | 0 | 29 | 0 | 29 | 0 |
| 30 | 0 | 30 | 0 | 30 | 0 |
| 31 | 0 | 31 | 0 | 31 | 0 |

FIG. 4B

| | \|8\| | \|7\| | \|6\| | \|5\| | \|4\| | \|3\| | \|2\| | \|1\| | \|0\| |
|---|---|---|---|---|---|---|---|---|---|
| \|0\| | 26 | 20 | 16 | 12 | 9 | 13 | 17 | 21 | 27 |
| \|1\| | 24 | 18 | 10 | 5 | 4 | 6 | 11 | 19 | 25 |
| \|2\| | 22 | 14 | 7 | 2 | 1 | 3 | 8 | 15 | 23 |
| | | | | | X | | | | |
| \|4\| | 23 | 15 | 8 | 3 | 1 | 2 | 7 | 14 | 22 |
| \|5\| | 25 | 19 | 11 | 6 | 4 | 5 | 10 | 18 | 24 |
| \|6\| | 27 | 21 | 17 | 13 | 9 | 12 | 16 | 20 | 26 |

| ADDRESS | DATA |
|---|---|
| 0 | 5 |
| 1 | 6 |
| 2 | 4 |
| 3 | 14 |
| 4 | 15 |
| 5 | 13 |
| 6 | 7 |
| 7 | 3 |
| 8 | 23 |
| 9 | 16 |
| 10 | 12 |
| 11 | 24 |
| 12 | 22 |
| 13 | 8 |
| 14 | 2 |
| 15 | 25 |
| 16 | 21 |
| 17 | 17 |
| 18 | 11 |
| 19 | 26 |
| 20 | 20 |
| 21 | 9 |
| 22 | 1 |
| 23 | 18 |
| 24 | 10 |
| 25 | 27 |
| 26 | 19 |
| 27 | 5 |
| 28 | 0 |
| 29 | 0 |
| 30 | 0 |
| 31 | 0 |

5 OVERRIDE MASK SETTINGS

480

FIG. 7

SYSTEM AND METHOD FOR HIGH SPEED INOPERATIVE INKJET COMPENSATION

TECHNICAL FIELD

The present disclosure relates generally to inkjet imaging apparatus and, more particularly, to compensation for missing ink in images to be ejected by defective inkjets.

BACKGROUND

Drop on demand inkjet technology for producing printed media has been employed in commercial products such as printers, plotters, and facsimile machines. Generally, an inkjet image is formed by selectively ejecting ink drops onto an image substrate from a plurality of drop generators or inkjets, which are arranged in a printhead or a printhead assembly. For example, the printhead assembly and the image substrate are moved relative to one another and the inkjets are controlled to eject ink drops at appropriate times. The timing of the inkjet activation is performed by a printhead controller, which generates firing signals that selectively activate inkjets to eject ink onto an image substrate. The image substrate may be an intermediate image member, such as a print drum or belt, from which the ink image is later transferred to a print medium, such as paper. The image substrate may also be a moving web of print medium or sheets of a print medium onto which the ink drops are directly ejected. The ink ejected from the inkjets may be liquid ink, such as aqueous, solvent, oil based, UV curable ink or the like, which is stored in containers installed in the printer. Alternatively, the ink may be loaded in a solid form and delivered to a melting device, which heats the solid ink to its melting temperature to generate liquid ink, which is supplied to a printhead.

During the operational life of an inkjet printer, inkjets in one or more of the printheads may become unable to eject ink reliably or accurately in response to receiving a firing signal. These inoperative inkjets may become operational after one or more image printing cycles. In other cases, the inkjet may remain unable to eject ink reliably or accurately until a purge cycle is performed. A purge cycle may successfully unclog inkjets so that they are able to eject ink once again. Execution of a purge cycle, however, requires the imaging apparatus to be taken out of its image generating mode. Thus, purge cycles affect the throughput rate of an imaging apparatus and are preferably performed during downtime. Inkjets that cannot reliably or accurately eject ink in response to a firing signal or that eject a smaller amount of ink than the firing signal would obtain from an operational inkjet are denoted as inoperative inkjets in this document.

Compensation methods have been developed that enable an imaging apparatus to generate images even though one or more inkjets in the imaging apparatus are unable to eject ink. These compensation methods cooperate with image rendering methods to control the generation of firing signals for inkjets in a printhead. Rendering refers to the processes performed by a marking engine that receives input image data values and generate output image values. The output image values are used to generate firing signals, which cause the inkjets of a printhead to eject ink onto the recording media. Once the output image values are generated, a compensation method may use information regarding defective inkjets detected in a printhead to identify the output image data values that correspond to one or more defective inkjets in the printhead. The marking engine then uses a compensation method to find a neighboring or nearby output image data value that can be adjusted to compensate for the defective inkjet. Preferably, an increase in the amount of ink ejected near the defective inkjet may be achieved by replacing a zero output image value with the output image value that corresponds to the defective inkjet.

Previously known compensation methods differ for the different versions of marking engines used in different types of inkjet printers. The distribution of the compensation image data values is typically based upon several printer-specific attributes such as droplet mass, halftone pattern design, one or more video interlacing schemes, and output print resolution. Although the fundamental method of distributing the compensation image data values to surrounding adoption sites is common between various inkjet printers, the parameters affecting the distribution vary with reference to the different print attributes of the marking engine in the different printers. These marking engine differences typically require individual programmed ASIC/FPGA designs in order to deliver the highest image quality possible for each specific printer marking engine. Therefore, making the different compensation methods easier to implement across an array of different inkjet printers would be useful.

SUMMARY

A new apparatus enables a common hardware configuration for implementing an inoperative inkjet compensation method to be capable of migration across different inkjet printers. The common hardware configuration is programmed with different data to provide a more flexible compensation scheme across different printers. The apparatus includes a plurality of mutliplexers, each multiplexer having a plurality of inputs for receiving a same plurality of image data pixels in an image, each multiplexer having a selector port that is configured to output one of the image data pixels in the plurality of image data pixels with reference to data provided to the selector port of the multiplexer in response to an enable signal being active at the multiplexer, a memory having a plurality of storage locations, an output of the memory being operatively connected to each selector port of the multiplexers in the plurality of multiplexers, each storage location in the memory providing data to each selector port in the plurality of multiplexers that selects one of the image data pixels in the plurality of image data pixels being received at the plurality of inputs at the multiplexer when the enable signal becomes active at the multiplexer, a decoder operatively connected to an output of each multiplexer to enable the decoder to receive the image data pixels from the plurality of multiplexers in a predetermined order, the decoder being configured to identify a highest priority image data pixel available for inoperative inkjet compensation in the plurality of image data pixels, and a controller configured to operate the memory to output the data stored at the plurality of storage locations in a first sequence and to activate the enable signal for each multiplexer selectively to enable the multiplexers to output the image data pixels in the predetermined order for the decoder.

A method operates the new apparatus to implement an inoperative inkjet compensation method across different inkjet printers. The method includes receiving a same plurality of image data pixels in an image at a plurality of inputs at each multiplexer in a plurality of mutliplexers, operating with a controller a memory having a plurality of storage locations to output data stored in the plurality of storage locations in a first sequence to a selector port of each multiplexer in the plurality of multiplexers, outputting one of the image data pixels in the plurality of image data pixels at the plurality of inputs of each multiplexer with reference to data provided to the selector port of each multiplexer in response to an enable signal being active at the multiplexer, receiving the image data pixels output from the plurality of multiplexers in a predetermined order at a decoder, identifying with the decoder a highest priority image data pixel available for inoperative inkjet compensation in the received image data pixels.

BRIEF DESCRIPTION OF THE DRAWINGS

The foregoing aspects and other features of an inkjet printing apparatus having an inoperative inkjet compensation apparatus are explained in the following description, taken in connection with the accompanying drawings.

FIG. 1 is an illustration of a sliding bitmap window used to evaluate locations for storing compensation image data values.

FIG. 2 is an illustration of another sliding bitmap window used to evaluate locations for storing compensation image data values.

FIGS. 4A and 4B depicts three different sliding bitmap windows and the data to be stored in a look up table memory to drive the apparatus of FIGS. 3A and 3B to enable evaluation of locations for compensation image values in the different sliding bitmap windows.

FIG. 7 illustrates a sliding bitmap window and the data stored in a look up table memory to enable edge mask removal of some pixel locations from compensation image data storage with possible location override.

DETAILED DESCRIPTION

Figure 3A:
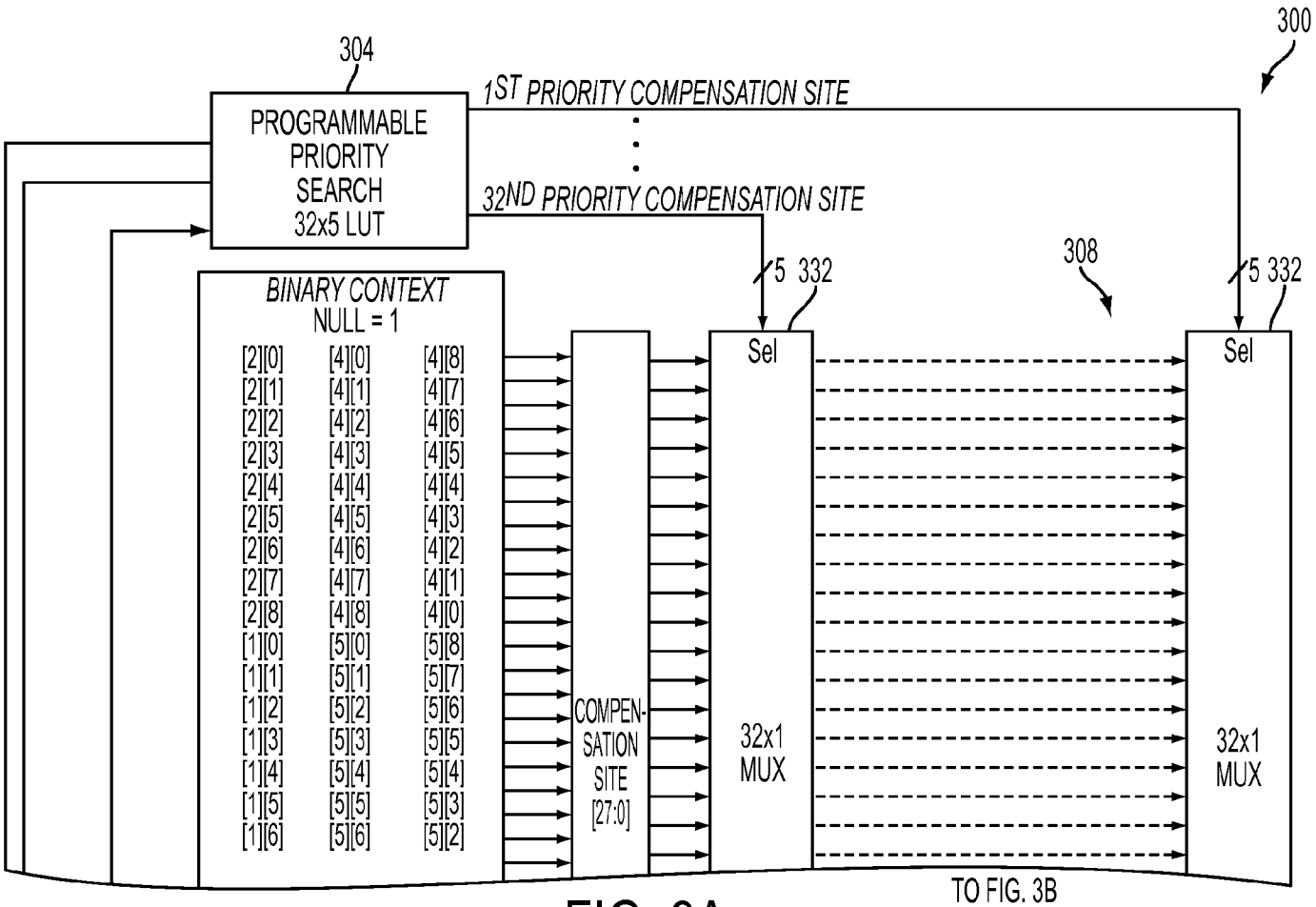
FIGS. 3A and 3B form a block diagram of an apparatus that enables locations in a sliding bitmap window to be evaluated for storing compensation image data values for a variety of sliding bitmap window configurations.

For a general understanding of the environment for the system and method disclosed herein and the details for the system and method, reference is made to the drawings. In the drawings, like reference numerals have been used throughout to designate like elements. As used herein, the words "printer" and "imaging apparatus", which may be used interchangeably, encompasses any apparatus that performs a print outputting function for any purpose, such as a digital copier, bookmaking machine, facsimile machine, a multi-function machine, etc. Furthermore, a printer is an apparatus that forms images with marking material on media and fixes and/or cures the images before the media exits the printer for collection or further printing by a subsequent printer.

Figure 9:
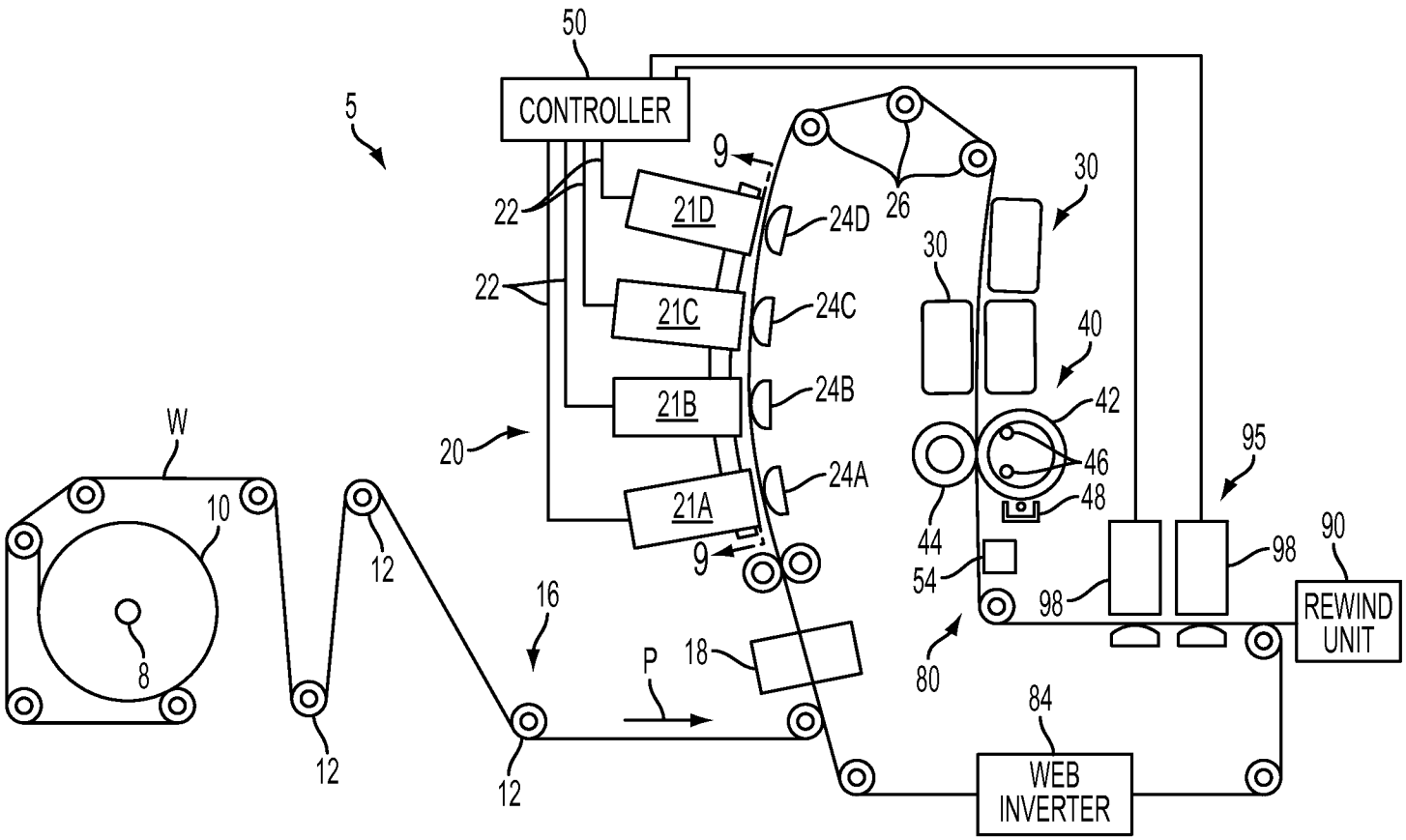
FIG. 9 PRIOR ART
FIG. 9 illustrates a prior art inkjet printing apparatus in which a system and method that better compensates for missing black ink in solid fill areas can be implemented.

FIG. 9 depicts an imaging apparatus 5 in which the apparatus and method described below can be implemented. The imaging apparatus 5 prints ink images onto a continuous media web. The imaging apparatus 5 shown in FIG. 9 forms a printed image on media by ejecting ink droplets from a plurality of inkjets arranged in one or more printheads. During the course of printing, one or more of the inkjets may become unavailable to eject ink. The system and method described below enables identification of locations within a sliding bitmap window that are available for compensating for inoperative inkjets. For example, a functional inkjet, referred to as a compensating inkjet, can be used to eject ink in place of an identified inoperative inkjet. Once the inoperative inkjets are identified through the user interface, they are deactivated by a printer controller and no longer used for printing until a maintenance operation is performed, which may rehabilitate the inoperative inkjets.

The imaging apparatus 5 includes a print engine to process the image data before generating the control signals for the inkjet ejectors for ejecting colorants. Colorants may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

The direct-to-sheet, continuous-media, phase-change inkjet imaging apparatus 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95 before being taken up by the rewind unit 90.

The media may be unwound from the source 10 as needed and propelled by a variety of motors, not shown, that rotate one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging apparatus. The pre-heater 18 brings the web to an initial predetermined temperature that is selected for desired image characteristics corresponding to the type of media being printed as well as the type, colors, and number of inks being used. The preheater 18 may use contact, radiant, conductive, or convective heat to bring the media to a target preheat temperature, which in one practical embodiment, is in a range of about 30° C. to about 70° C.

The media is transported through a printing station 20 that includes a series of color units or modules 21A, 21B, 21C, and 21D, each color module effectively extends across the width of the media and is able to eject ink directly (i.e., without use of an intermediate or offset member) onto the moving media. The arrangement of printheads in the print zone of the system 5 is discussed in more detail with reference to FIG. 10 below.

The imaging apparatus may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each color module is a backing member 24A-24D, typically in the form of a bar or roll, which is arranged substantially opposite the printhead on the back side of the media. Each backing member is used to position the media at a predetermined distance from the printhead opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

Following the printing station 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. Following the mid-heaters 30, a fixing assembly 40 is configured to apply heat and/or pressure to the media to fix the images to the media. The term "fixing" may refer to the stabilization of ink on media through components operating on the ink and/or the media, including, but not limited to, fixing rollers and the like. In the embodiment of the FIG. 9, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. The spreader 40 includes rollers, such as image-side roller 42 and pressure roller 44, to apply heat and pressure to the media. Either roller can include heat elements, such as heating elements 46, to bring the web W to a temperature in a range from about 35° C. to about 80° C.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page.

The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 may apply the clear ink with either a roller or a printhead 98 ejecting the clear ink in a pattern. Clear ink for the purposes of this disclosure is functionally defined as a substantially clear overcoat ink that has minimal impact on the final printed color, regardless of whether or not the ink is devoid of all colorant.

Following passage through the spreader 40, the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 5 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the compensation function, described below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively connected to the printheads of color modules 21A-21D in order to operate the printheads to form the test patterns with indicia described below to enable visual detection of defective inkjets.

The imaging apparatus 5 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The optical imaging system may include an array of optical detectors/sensors mounted to a bar or other longitudinal structure that extends across the width of an imaging area on the image receiving member. In one embodiment in which the imaging area is approximately twenty inches wide in the cross process direction and the printheads print at a resolution of 600 dpi in the cross process direction, over 12,000 optical detectors are arrayed in a single row along the bar to generate a single scanline across the imaging member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the image receiving member is larger than the magnitude of a signal generated in response to light reflected from a drop of ink on the image receiving member. This difference in the magnitude of the generated signal may be used to identify the positions of ink drops on an image receiving member, such as a paper sheet, media web, or print drum. The reader should note, however, that lighter colored inks, such as yellow, cause optical detectors to generate lower contrast signals with respect to the signals received from unlinked portions than darker colored inks, such as black. Thus, the contrast may be used to differentiate between dashes of different colors. The magnitudes of the electrical signals generated by the optical detectors may be converted to digital values by an appropriate analog/digital converter. These digital values are denoted as image data in this document and these data are analyzed to identify positional information about the dashes on the image receiving member as described below.

Figure 10:
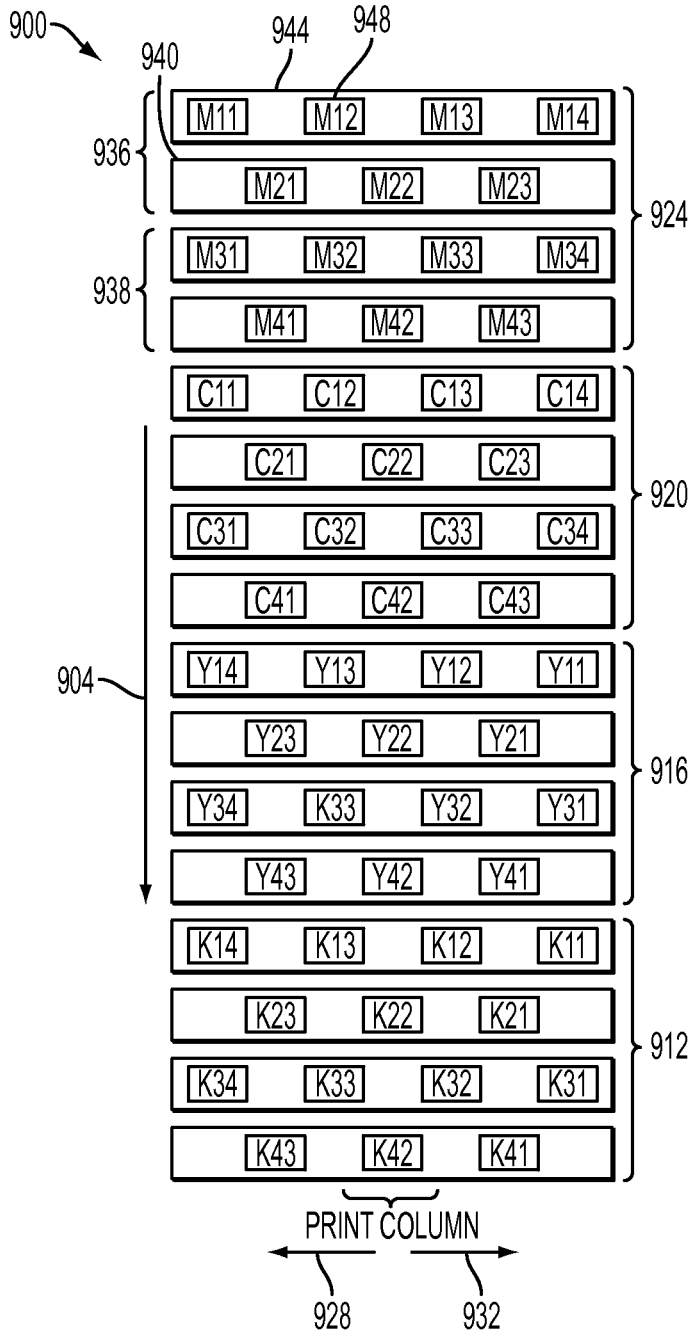
FIG. 10 PRIOR ART
FIG. 10 illustrates a schematic view of a prior art printhead configuration viewed along lines 9-9 in FIG. 9.

A schematic view of a prior art print zone 900 that may be used in the imaging apparatus 5 is depicted in FIG. 10. The printheads of this print zone can be operated as described below to print a test pattern with indicia that enables visual detection of defective inkjets. The print zone 900 includes four color modules or units 912, 916, 920, and 924 arranged along a process direction 904. Each color unit ejects ink of a color that is different than the other color units. In one embodiment, color unit 912 ejects black ink, color unit 916 ejects yellow ink, color unit 920 ejects cyan ink, and color unit 924 ejects magenta ink. Process direction 904 is the direction that an image receiving member moves as it travels under the color unit from color unit 924 to color unit 912. The arrows 928 and 932 indicate the cross-process direction across the web and the words "Print Column" refer to the lines printed by the inkjet ejectors in the printheads M22, M42, C22, C42, Y22, Y42, B22, and B42 that extend in the process direction. Each color unit includes two print arrays, which include two print bars each that carry multiple printheads. For example, the print bar array 936 of magenta color unit 924 includes two print bars 940 and 944. Each print bar carries a plurality of printheads, as exemplified by printhead 948. Print bar 940 has three printheads, while print bar 944 has four printheads, but alternative print bars may employ a greater or lesser number of printheads. The printheads on the print bars within a print bar array, such as the printheads on the print bars 940 and 944, are staggered to provide printing across the image receiving member in the cross process direction at a first resolution. The printheads on the print bars of the print bar array 936 within color unit 924 are interlaced with reference to the printheads in the print bar array 938 to enable printing in the colored ink across the image receiving member in the cross process direction at a second resolution. The print bars and print bar arrays of each color unit are arranged in this manner. One print bar array in each color unit is aligned with one of the print bar arrays in each of the other color units. The other print bar arrays in the color units are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer.

Figure 11:
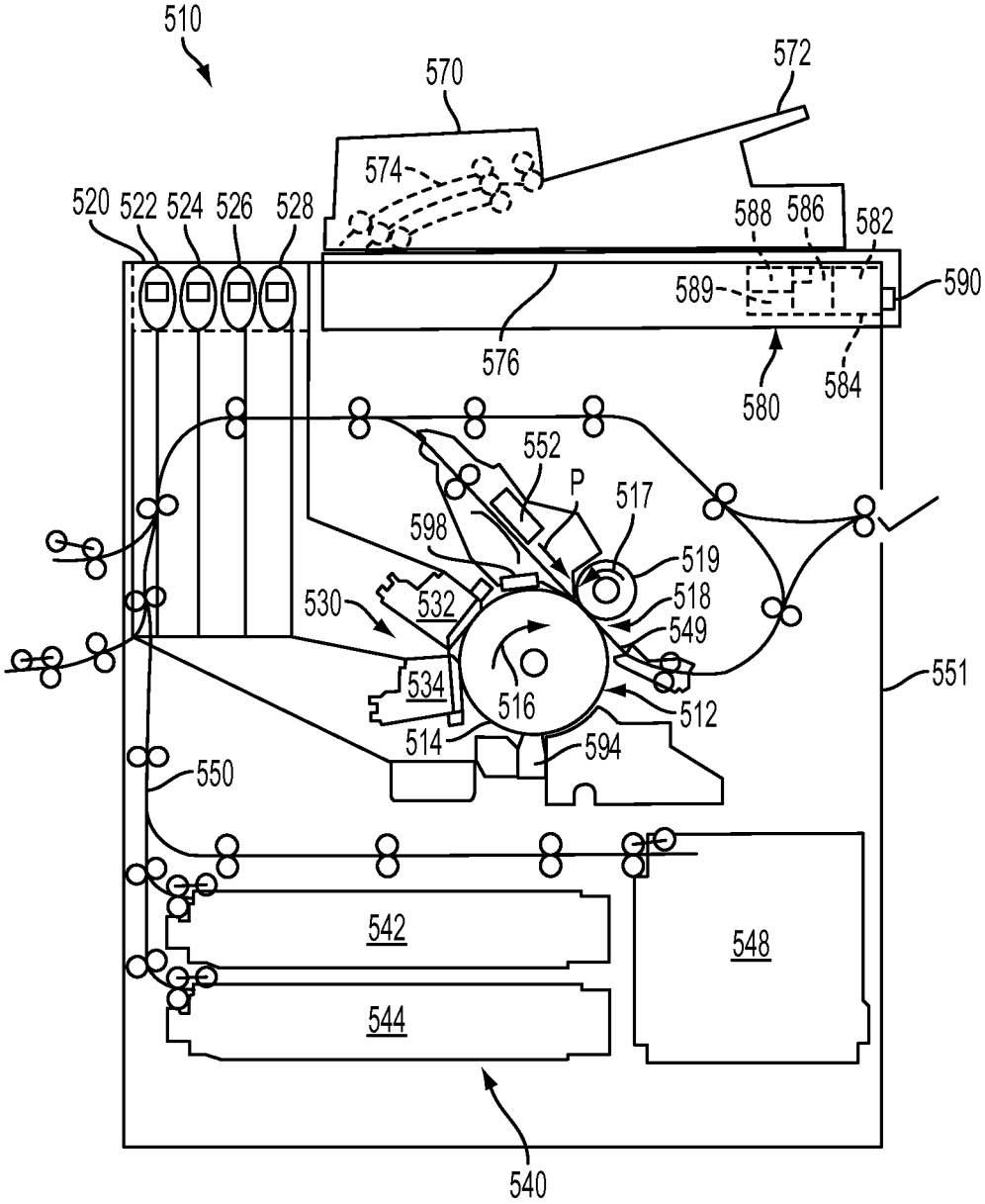
FIG. 11 PRIOR ART
FIG. 11 illustrates a prior art inkjet printing apparatus in which a system and method can be implemented that identifies locations in a sliding bitmap window available for compensating for inoperative inkjets.

Although the system and method disclosed herein are described with reference to the printer 5, the system and method can also be implemented in intermediate printing process printers. Such a printer is shown in FIG. 11. The printer 500 has a housing 511. Within the housing, image surface 514 of rotating image drum 512 has a layer of release agent, such as silicone oil, applied to the surface by release agent applicator 594. An ink delivery system 520 includes ink supplies 522, 524, 526, and 528 that supply ink to the printing assembly 530 having printhead arrays 532 and 534. As the drum rotates in direction 516 past the printhead arrays 532 and 534, the printheads eject ink onto the layer of release agent during one or more passes of the surface past the printheads to form an ink image. After the ink image is formed, a sheet of media is moved by media transport 550 from one of the media trays 542, 544, and 548 in media storage 540 to the surface 514 of rotating drum 512. The media is heated by heater 552 before the ink image is transferred to the media sheet. Delivery of the media to the nip formed between transfix roller 519 and rotating drum 512 is synchronized to arrive at the nip as the ink image on the surface 514 reaches the nip. In the nip, the ink image is transferred and fixed to the media sheet. The printheads in these printers can be arranged in staggered arrays similar to those shown in FIG. 10. In some of these intermediate print process printers, each printhead can eject more than one color of ink.

The printer 500 also includes an original document feeder 570 that has a document holding tray 572, document sheet feeding and retrieval devices 574, and a document exposure and scanning subsystem 576. Operation and control of the various subsystems, components and functions of the printer 500 are performed with the aid of a controller or electronic subsystem (ESS) 580. The ESS or controller 580, for example, is a self-contained, dedicated mini-computer having a central processor unit (CPU) 582 with a digital memory 584, and a display or user interface (UI) 586. The ESS or controller 580, for example, includes a sensor input and control circuit 588 as well as an ink drop placement and control circuit 589. In one embodiment, the ink drop placement control circuit 589 is implemented as a field programmable gate array (FPGA). In addition, the CPU 582 reads, captures, prepares and manages the image data flow associated with print jobs received from image input sources, such as the scanning system 576, or an online or a work station connection 590. As such, the ESS or controller 580 is the main multi-tasking processor for operating and controlling all of the other printer subsystems and functions. As noted above with regard to the controller of printer 5 in FIG. 9, the controller 80 can be implemented with general or specialized programmable processors that execute programmed instructions, for example, printhead operation.

While the system and method of providing an apparatus for compensating for inoperative inkjets are discussed in the context of a solid ink imaging apparatus, they can also be used with imaging apparatus that use other types of liquid ink, such as aqueous, emulsified, gel, UV curable inks, or inks having magnetic properties such as those used in magnetic ink character recognitions systems ("MICR"). Therefore, the system and method can be used in any imaging apparatus that provides liquid ink to one or more printheads, including cartridge inkjet systems.

A bitmap sliding window that is useful for identifying locations for storage of compensation image data values is shown in FIG. 1. In FIG. 1, the "x" location represents an image data value to be ejected by an inoperative inkjet and the positions on either side of the "x" represent other image data values to be printed by the same inkjet. The bitmap sliding window 150 of FIG. 1 is a window of seven pixels by nine pixels centered about an image data value to be ejected by an inoperative inkjet. The window slides through a memory of image data to be printed and is stopped where the image data value for an inoperative inkjet is non-zero. The window need not stop at zero image data values as no ink would be ejected at such locations. The window contains twenty-seven (27) pixels on each side of the image data column corresponding to the inoperative inkjet and these pixels are identified by the numbers 1 . . . 27 in the figure. One group of twenty-seven pixels is designated the right side group 154 and the other group of twenty-seven pixels is designated the left side group 158. In FIG. 1, the upper group is the right side group and the lower group is the left side group, although the reverse could be used. The pixels in the right side group and left side group can be identified by a row index and column index in the window, which corresponds to a row and column within the image. In FIG. 1, the right side group pixels are in rows [0], [1], and [2], while the left side group pixels are in rows [4], [5], and [6]. The columns are [0] to [8] for both groups. The pixels in each group of the sliding bitmap window 150 are searched to identify candidate locations for compensation image data values.

FIG. 2 is another sliding bitmap window 170 used to identify candidate locations for compensation image data values. This window is also seven pixels by nine pixels that are centered about an image data value for an inoperative inkjet marked with an "x." The right side group of pixels 174 is organized as the right side group of pixels 154 shown in FIG. 1. The left side group of pixels 178, however, is reversed from the left side group of pixels shown in FIG. 1. Thus, the two groups of pixels in the sliding bitmap window of FIG. 2 are configured in a mirror arrangement.

Figure 3B:
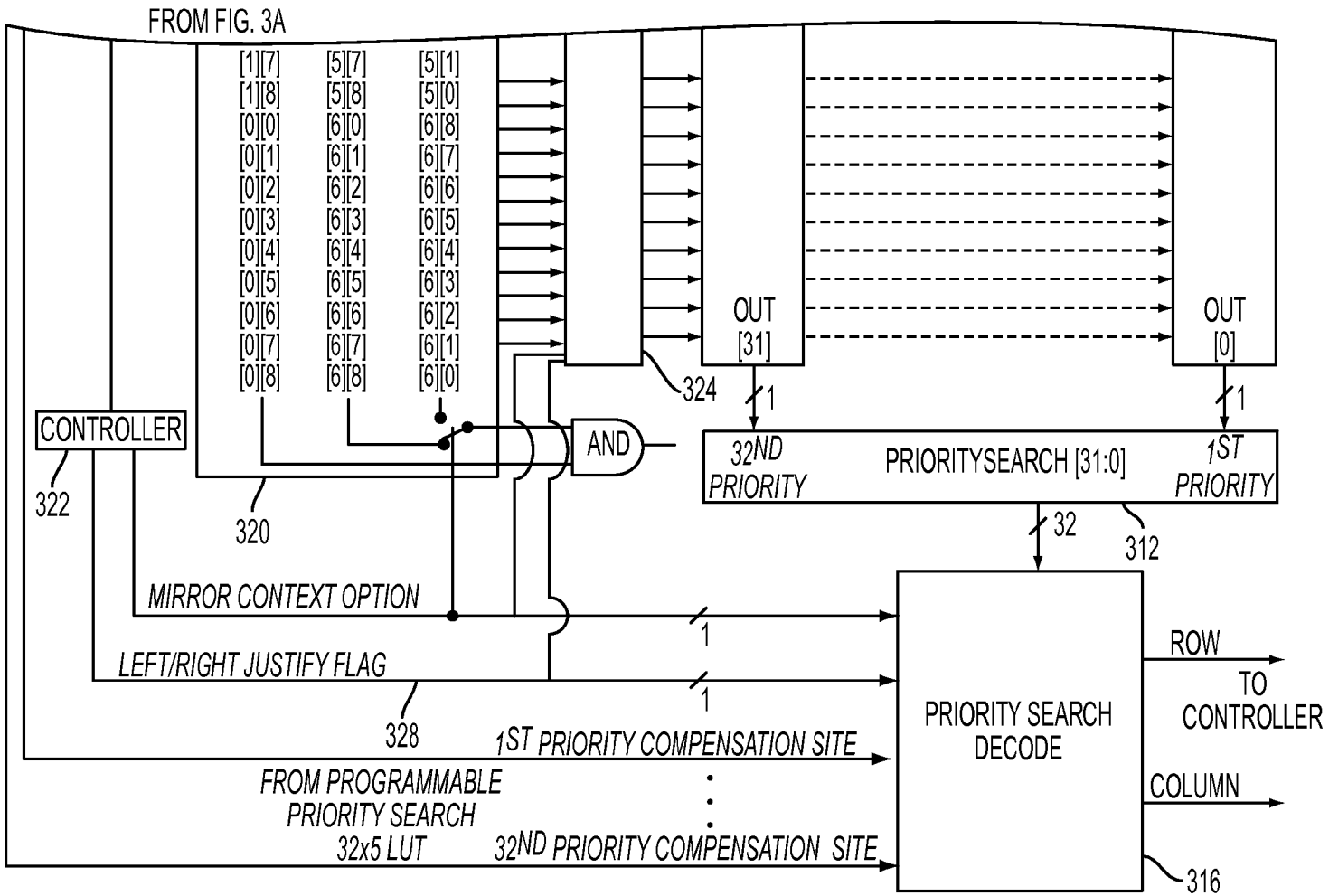

FIGS. 3A and 3B depicts a hardware apparatus 300 that implements an inoperative inkjet compensation scheme for a variety of printers and search patterns. The apparatus 300 includes a memory 304, a plurality of multiplexers 308, a buffer 312, a decoder 316, an image data memory 320, and a controller 322. The image data memory 320 stores a binary image of the image data values in an image that are within one group of pixels in a sliding bitmap window within an image, such as the ones shown in FIG. 1 and FIG. 2. Each memory location has a value of "1" where an inkjet is to be fired to eject ink and a value of "0" where no ink is to be ejected. The twenty-seven pixels of the right group and the twenty-seven pixels of the left group are provided to a selector 324. With reference to a left/right justify flag 328, the selector selects a left or right group of twenty-seven pixel values and outputs the selected pixels to each of the multiplexers in the plurality of multiplexers 308. Each multiplexer has a selector port 332 that is operatively connected to the output of memory 304. Memory 304 has an address space that identifies a memory location for each multiplexer. In the embodiment shown in FIGS. 3A and 3B, thirty-two multiplexers are provided so the address space of memory 304 is for memory locations [00]-[31]. The data at each memory location in the memory 304 either uniquely identifies one of the twenty-seven pixels in the group of pixels selected by the selector 324 or a predetermined value to be output by the multiplexer. Thus, by sequencing through the addresses [00] to [26] on the address bus of memory 304, the contents of each location in a group within the sliding bitmap window are output and directed to one of the first twenty-seven multiplexers in the plurality of multiplexers 308 to select one of the twenty-seven pixels in the selected group of pixels presented to a multiplexer. The multiplexers corresponding to [27] to [31] are discussed in more detail below. The one bit output of each multiplexer is output to the buffer 312 to form a concatenated string of bits [0] to [31]. The decoder 316 identifies the first zero bit in the buffer 312, beginning with bit [0], as the highest priority candidate location for storage of a compensation image data value. The decoder 316 also receives the data from the memory 304 that was sent to the selector port on the multiplexer that passed through the first zero bit along with the left/right justify flag to identify the row and column in the group of pixels from the sliding bitmap window for storage of the compensation image data value. The decoder 316 compares the result of the two groups of pixels and selects the highest priority location between them. The row and column of the highest priority site is then sent to the controller for the marking engine to enable the marking engine controller to store a compensation image data value at the identified row and column position.

Figure 4A:
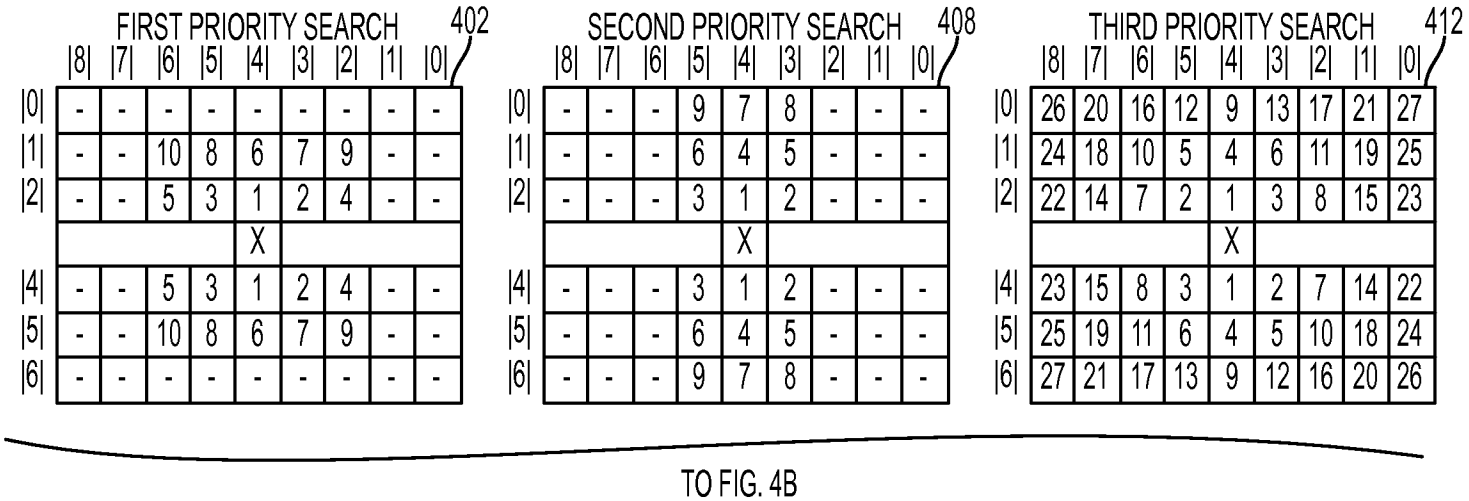

FIGS. 4A and 4B depict three different prioritized search schemes within a sliding bitmap window. Scheme 402 has ten pixels in each of the left and right groups of pixels and the pixels in the two groups are arranged in a non-mirrored arrangement. Beneath the illustrated search scheme are the address locations and corresponding data stored in the locations in the memory 304 to implement the search scheme. The data in the address 0 location is a "5," which corresponds to bit "5" in either group of the scheme. In the image data memory 320 of FIGS. 3A and 3B, position 5 corresponds to the pixel at [2][4] in the right group and to the pixel [4][4] in the left group. Thus, the data content "5" from the memory 304 is directed to multiplexer 0 to select the pixel content from [2][4] or [4] [4] from the image data output from the memory 320 depending on whether the left/right justify flag indicates the right or the left group is being evaluated. This pixel value passes through the multiplexer to the buffer 312 for testing by the decoder 316 to determine whether it is a "1" or "0." In a similar manner, the data in locations 1 through 9 select the appropriate pixel value for the corresponding multiplexer that directs the pixel value to the buffer 312 for testing by decoder 316. The first zero pixel value is the highest priority candidate location in the group being evaluated. After the other group of pixels is tested, the highest priority candidate location in each group is compared to the highest priority candidate location in the other group to determine the highest priority candidate location in the sliding bitmap window. The remaining locations in the memory 304 are programmed with the data content of "0." A "0" at the selector port of any multiplexer causes the multiplexer to output a "1" into the buffer 312, which eliminates the location as a possible candidate for a compensation image data value. The second search scheme 408 is programmed in a similar manner as scheme 402 since search scheme 408 is also for a non-mirrored arrangement within the sliding bitmap window. Search scheme 408 only has nine locations in each group so only the first nine locations 0-8 are programmed with data to select a pixel value from the sliding bitmap window and the remaining locations are programmed with a "0" to force a "1" in the buffer 312 from the multiplexers for those locations.

The third search scheme 412 in FIG. 4A has twenty-seven pixels in each of the left and right groups of pixels and the pixels in the two groups are arranged in a mirrored arrangement. The address locations and corresponding data stored in the locations in the memory 304 to implement the search scheme for the right group is shown beneath the scheme map 412. These data are produced by the memory 304 in the order depicted in response to the controller 322 sequencing through the addresses 0 to 26 in a consecutive sequential order. Thus, the multiplexers direct the corresponding pixel values to the buffer 312 for testing by decoder 316 with the first zero pixel value being the highest priority candidate location in the right group of pixels. To evaluate the pixels in the left group of pixels, the controller 322 sequences through the addresses in an order that corresponds to the mirror arrangement of the left group. For example, the controller goes in the order of 0, 2, 1, 3, 5, 4, 6, 8, 7 . . . to direct the pixel values from the sliding bitmap window to the multiplexers in the appropriate order for filling the buffer 312. By driving the memory 304 in this manner, a second memory does not need to be used for the mirror arrangement of the second group of pixels. Alternatively, a second memory could have data stored in the memory that corresponds to the left group of pixels in the mirror arrangement. This memory could be driven in a consecutive sequential order in response to the mirror signal indicating the mirror arrangement group is being evaluated. The last five storage locations in the memory 304 are zeros to force a "1" into the buffer for these locations that do not correspond to a position in the sliding bitmap window. After each group of pixels is tested, the highest priority candidate location in each group is compared to the highest priority candidate location in the other group to determine the highest priority candidate location in the sliding bitmap window.

Figure 5A:
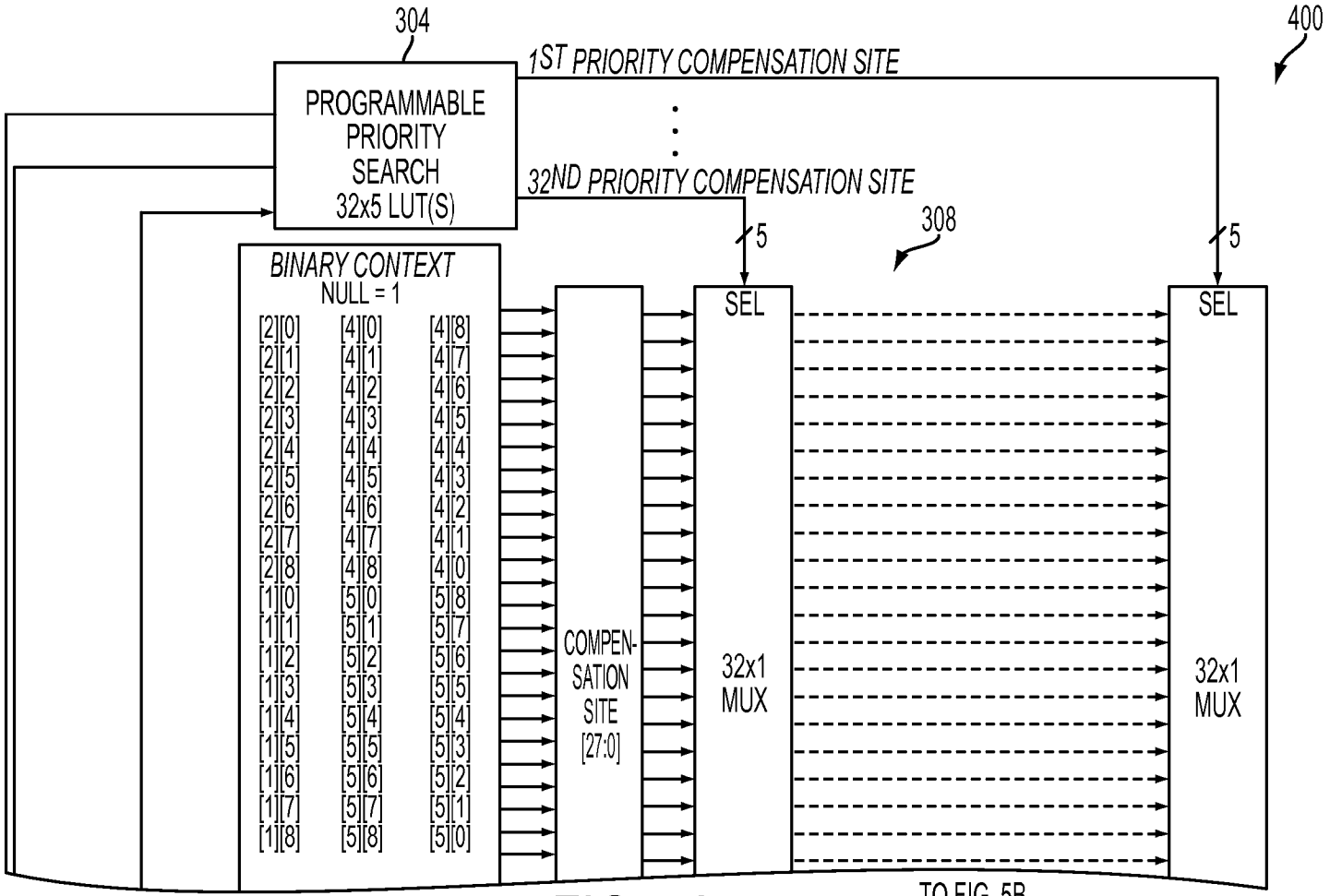
FIGS. 5A and 5B form a block diagram for an alternative embodiment of an apparatus that enables locations in a sliding bitmap window to be evaluated for storing compensation image data values for a variety of sliding bitmap window configurations.
Figure 5B:
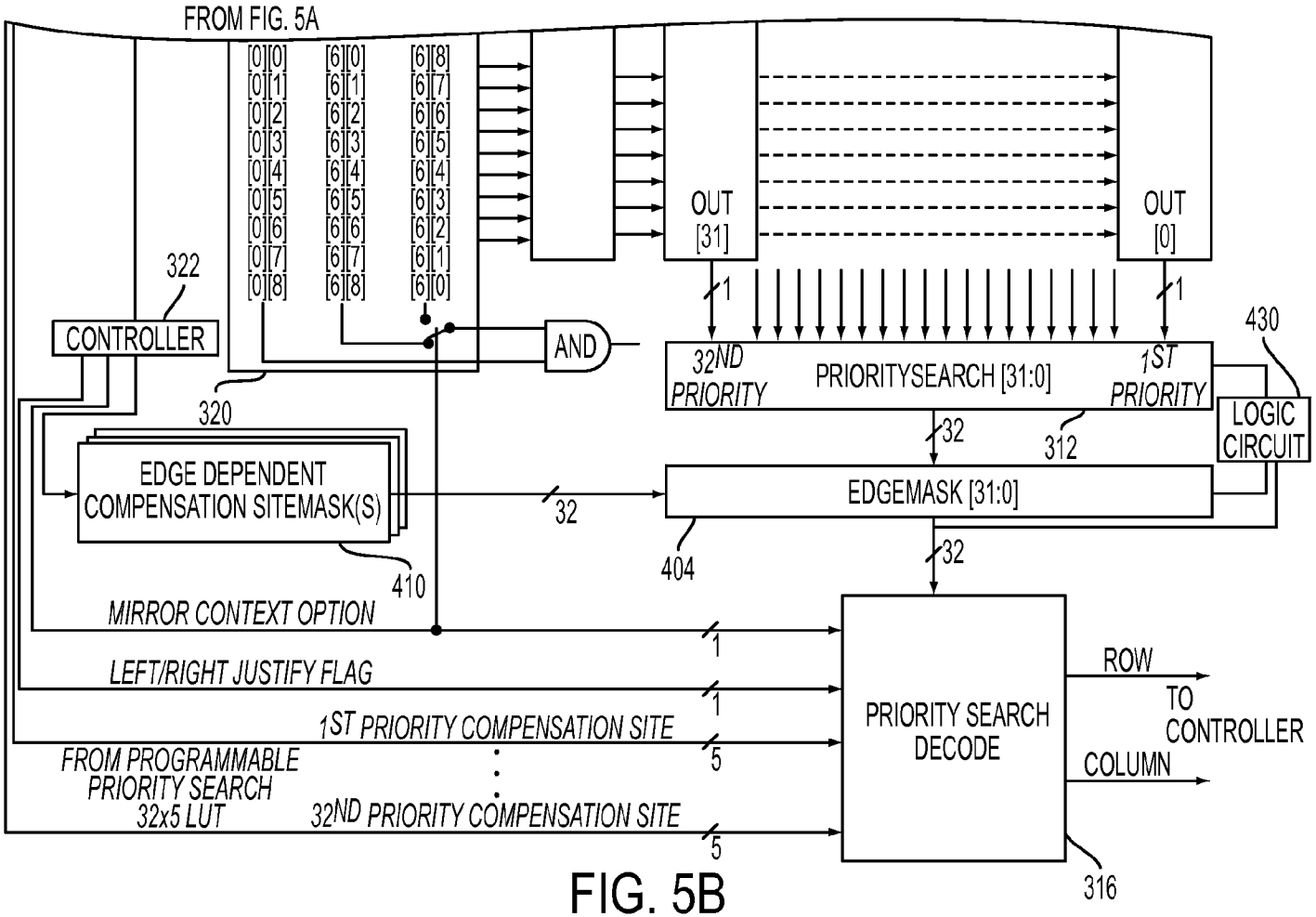
Figure 6:
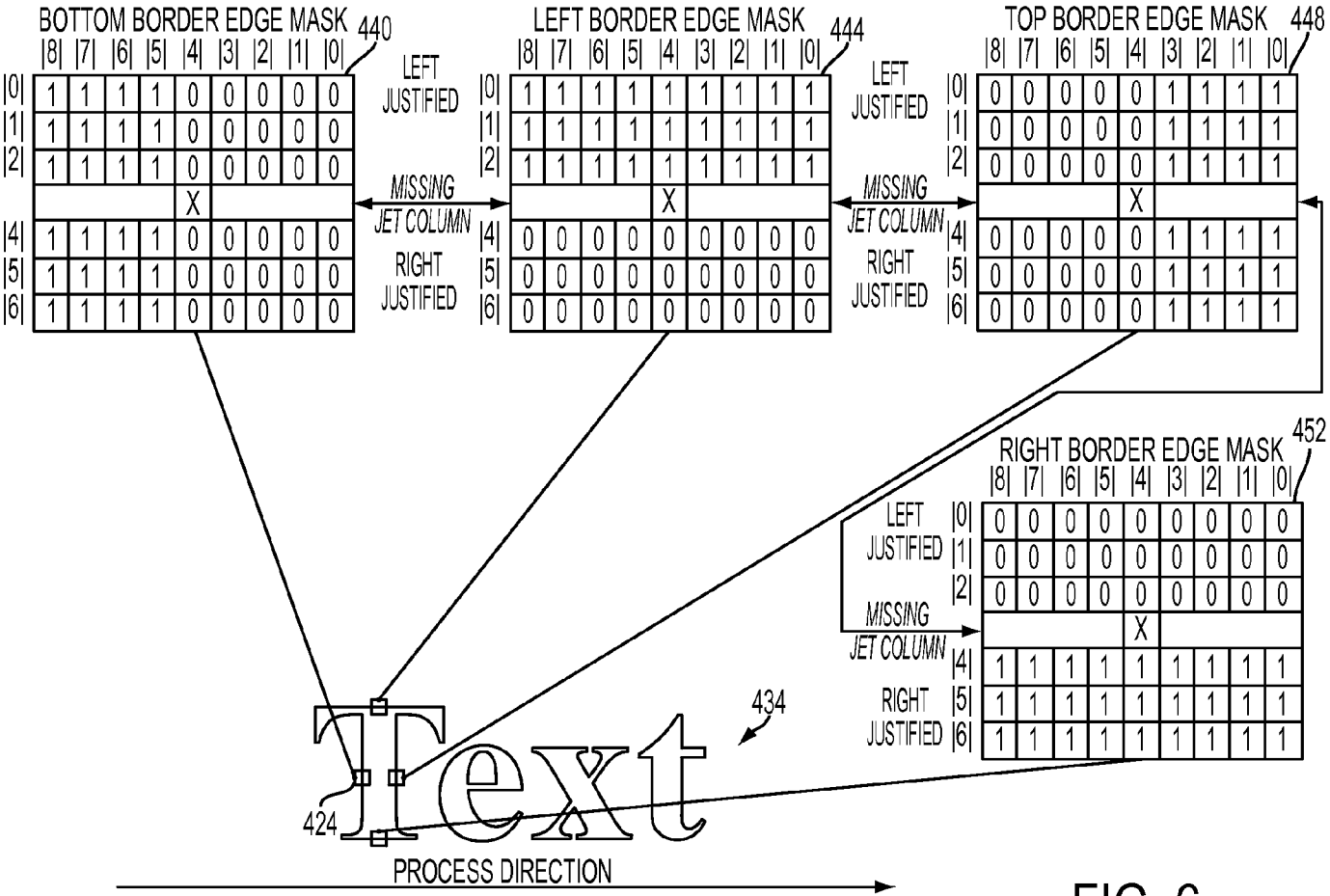
FIG. 6 illustrates the use of edge masks to remove image data locations from within a sliding bitmap window for evaluation of locations for storing compensation image data values.

Another embodiment of the apparatus is shown in FIGS. 5A and 5B. Using like reference numbers for like components, the apparatus 400 includes the memory 304, the plurality of multiplexers 308, the buffer 312, the decoder 316, the image data memory 320, and the controller 322 of apparatus 300. These components operate as described above except the concatenation of the image data bits in the buffer 312 are ORed with an edge mask stored in the edge mask buffer 404 by the logical circuit 430 and the decoder 316 identifies the highest priority candidate location for a compensation image data value from the resulting logical OR result received from the logical circuit 430. The function of the edge mask buffer 404 is explained with reference to FIG. 5A, 5B and FIG. 6. As shown in FIG. 6, the image data to be printed forms the word "TEXT" 434. When the sliding bitmap window is centered at the pixels identified by the squares on the edges of the letter "T" in the figure, consideration of certain candidate locations is prohibited to prevent the insertion of compensation image data values at locations that would cause ink to be ejected in the area outside of the letter "T." If ink were ejected into these areas, then the edges of the letter would appear ragged and image quality would be degraded. Each of the locations is correlated to an edge mask 440, 444, 448, or 452 in the figure. When the sliding bitmap window is centered on the square 424, the controller 322 selects edge mask 440 from memory 410 and loads it into the edge mask buffer 404. When the contents of buffer 312 are logically ORed with the corresponding left or right group of the edge mask in buffer 404 by the logical circuit 430, the bits in the mask buffer that correspond to the positions containing a "1" become a "1" so the decoder 316 detects the corresponding location is not available for a compensation image data value. This operation would enable only the locations within the left side of the stem of the "T" in FIG. 6 to be evaluated for storage of compensation image data values. Similarly, edge mask 444 enables only those locations in the upper portion of the cap in the "T" to be evaluated; edge mask 448 enables only those locations in the right side of the stem of the "T" to be evaluated; and edge mask 452 enables only those locations in the base of the "T" to be evaluated. These operations with the edge masks remove the pixel locations outside of the letter "T" from compensation image data value storage evaluation.

In some cases, a compensation image data value can be placed immediately near the border regions. Using these locations for a compensation image data value in effect "overrides" the edge mask. This type of override operation is performed after an exhaustive search has been completed for compensation image data value candidate locations within the interior of the text and/or line-art regions. This override allows precise placement of the orphaned pixel if, and only if, no other compensation image data value candidate locations are found elsewhere. Typically, these override sites are located immediately to the right/left of the pixel corresponding to the inoperative inkjet. These positions are located at [2] [4] or [4] [4] in the sliding bitmap window shown in FIG. 1 or 2. To implement an override function in the apparatus 400, data is stored in the last five address locations of the memory 304 to provide this override capability. For example, as shown in FIG. 7, the locations 0 to 26 in memory 304 have data stored in them that provide data from the left and right group of the sliding bitmap window shown in the figure. These data are then ORed with an appropriate edge mask when the window is centered at an edge as discussed above. If any locations are identified by the decoder 316 as being available for a compensation image data value, the comparison with the available locations in the other group are compared and the highest priority location is selected. If no such location is available, however, the data "5" from address 27 (reference number 480 in FIG. 7) enables the data from that position in the sliding bitmap window to be provided to the twenty-seventh bit position in the buffer 312 and the edge mask has a "0" in these last five locations to enable the data from those locations in the sliding bitmap window to pass through to the decoder. Thus, if no image data are in location "5" of the sliding bitmap window, then that location can be identified as being available for storage of a compensation image data value even though it may have been removed by the logical operation with the edge mask.

Figure 8:
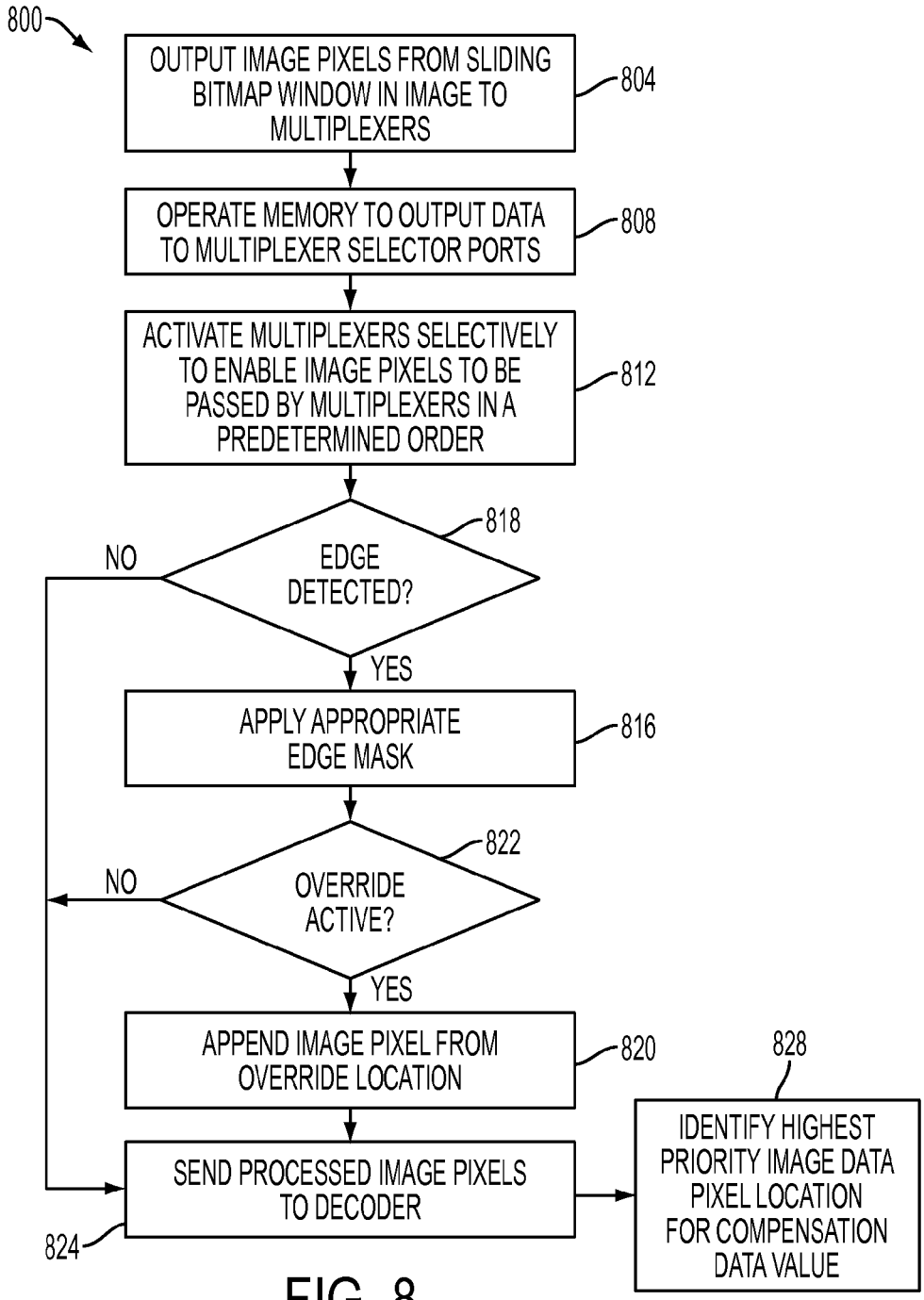
FIG. 8 depicts a flow diagram for operating an apparatus that evaluates pixel locations in a sliding bitmap window for storage of compensation image data values.

A method for operating an apparatus to evaluate pixel locations in different sliding bitmap windows used in different inkjet printers is shown in FIG. 8. In the description of the method, a statement that the process does some function or performs some action refers to a controller executing programmed instructions to do the function or perform the action or to the controller generating signals to operate one or more electrical or electromechanical components to perform the function or action. While process 800 is described with reference to a printer that ejects melted phase change ink, it could be implemented with printers that eject other types of ink. The process 800 begins with the controller receiving a same plurality of image data pixels in an image at a plurality of inputs at each multiplexer in a plurality of mutliplexers (block 804). A controller operates a memory having a plurality of storage locations to output data stored in the plurality of storage locations in a first sequence to a selector port of each multiplexer in the plurality of multiplexers (block 808). Each multiplexer outputs one of the image data pixels in the plurality of image data pixels on the inputs of each multiplexer (block 812). The pixel is selected with reference to data provided to the selector port of each multiplexer in response to an enable signal being active at the multiplexer. The passed through pixels can be masked with an edge mask (block 816) by a logical circuit if an edge is detected in sliding bitmap window by the controller (block 818). If an override location in the memory is active (822), a pixel removed by the edge mask can be inserted at the low end of the output of the logical circuit (block 820). The processed image data pixels are provided to a decoder in a predetermined order (block 824). The decoder then identifies a highest priority image data pixel available for inoperative inkjet compensation in the received image data pixels (block 828).

The methods disclosed herein may be implemented by a processor being configured with instructions and related circuitry to perform the methods. Additionally, processor instructions may be stored on computer readable medium so they may accessed and executed by a computer to operate an apparatus to evaluate pixel locations in different sliding bitmap windows used in different inkjet printers. Accordingly, storing such instructions on computer readable media within the printer shown in FIG. 9 or 11 configures one or more controllers in the printer to perform the methods described above takes that printer out of the prior art. Such a printer would then be configured to operate an apparatus to evaluate pixel locations in different sliding bitmap windows used in different inkjet printers.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An apparatus for identifying an inkjet to compensate for a defective inkjet comprising:

a plurality of mutliplexers, each multiplexer having a plurality of inputs for receiving a same plurality of image data pixels in an image, each multiplexer having a selector port that is configured to output one of the image data pixels in the plurality of image data pixels with reference to data provided to the selector port of the multiplexer in response to an enable signal being active at the multiplexer;

a memory having a plurality of storage locations, an output of the memory being operatively connected to each selector port of the multiplexers in the plurality of multiplexers, each storage location in the memory providing data to each selector port in the plurality of multiplexers that selects one of the image data pixels in the plurality of image data pixels being received at the plurality of inputs at the multiplexer when the enable signal becomes active at the multiplexer;

a decoder operatively connected to an output of each multiplexer to enable the decoder to receive the image data pixels from the plurality of multiplexers in a predetermined order, the decoder being configured to identify a highest priority image data pixel available for inoperative inkjet compensation in the plurality of image data pixels that is between a highest priority image data pixel on a first side of the inoperative inkjet and a highest priority image data pixel on a second side of the inoperative inkjet; and a controller configured to generate a first signal that identifies the image data pixels at the plurality of inputs at the multiplexers as being on the first side or the second side of an image data pixel to be ejected by an inoperative inkjet, to operate the memory to output the data stored at the plurality of storage locations in a first sequence in response to the first signal identifying the image data pixels as being on the first side of the image data pixel to be ejected by the inoperative inkjet and to operate the memory to output the data stored in the plurality of storage locations in a second sequence in response to the first signal identifying the image data pixels as being on the second side of the image data pixel to be ejected by the inoperative inkjet, the first sequence of data being different than the second sequence of data and to activate the enable signal for each multiplexer selectively to enable the multiplexers to output the image data pixels in the predetermined order for the decoder.

2. The apparatus of claim 1, the decoder being further configured to identify the highest priority image data pixel with a row index and a column index within the image.

3. The apparatus of claim 1, each multiplexer in the plurality of multiplexers being configured to output a first predetermined value in response to a second predetermined value being present at the selector port and the enable signal being active.

4. An apparatus for identifying an inkjet to compensate for a defective inkjet comprising:

a plurality of mutliplexers, each multiplexer having a plurality of inputs for receiving a same plurality of image data pixels in an image, each multiplexer having a selector port that is configured to output one of the image data pixels in the plurality of image data pixels with reference to data provided to the selector port of the multiplexer in response to an enable signal being active at the multiplexer;

a first memory having a plurality of storage locations, an output of the memory being operatively connected to each selector port of the multiplexers in the plurality of multiplexers, each storage location in the first memory providing data to each selector port in the plurality of multiplexers that selects one of the image data pixels in the plurality of image data pixels being received at the plurality of inputs at the multiplexer when the enable signal becomes active at the multiplexer;

a second memory having a predetermined number of storage locations, the predetermined number of storage locations in the second memory corresponding to a number of multiplexers in the plurality of multiplexers;

a decoder operatively connected to an output of each multiplexer to enable the decoder to receive the image data pixels from the plurality of multiplexers in a predetermined order, the decoder being configured to identify a highest priority image data pixel available for inoperative inkjet compensation in the plurality of image data pixels;

a logical circuit configured to combine data output by the plurality of multiplexers with data stored in the second memory to disable at least one image data pixel output by at least one multiplexer from being identified as the highest priority image data pixel; and a controller configured to operate the memory to output the data stored at the plurality of storage locations in a first sequence and to activate the enable signal for each multiplexer selectively to enable the multiplexers to output the image data pixels in the predetermined order for the decoder.

5. The apparatus of claim 4, the controller being further configured to store data in the second memory with reference to edges detected in the image data.

6. The apparatus of claim 4, the memory being further configured to enable at least one other multiplexer in the plurality of multiplexers to output the image data pixel removed from being identified as the highest priority image data pixel; and the controller being further configured to store data in the second memory that enables the logical circuit to provide the image data pixel removed from being identified as the highest priority image data pixel to the decoder.

7. A method of prioritizing image data pixel locations for inoperative inkjet compensation comprising:

receiving a same plurality of image data pixels in an image at a plurality of inputs at each multiplexer in a plurality of mutliplexers;

generating with a controller a first signal that identifies the image data pixels at the plurality of inputs at the multiplexers as being on a first side or a second side of an image data pixel to be ejected by an inoperative inkjet;

operating with the controller a memory having a plurality of storage locations to output data stored in the plurality of storage locations in a first sequence to a selector port of each multiplexer in the plurality of multiplexers in response to the first signal identifying the image data pixels as being on the first side of the inoperative inkjet and operating the memory with the controller to output the data stored in the plurality of storage locations in a second sequence in response to the first signal identifying the image data pixels as being on the second side of the inoperative inkjet, the first sequence of data being different than the second sequence of data;

outputting one of the image data pixels in the plurality of image data pixels at the plurality of inputs of each multiplexer with reference to data provided to the selector port of each multiplexer in response to an enable signal being active at the multiplexer;

receiving the image data pixels output from the plurality of multiplexers in a predetermined order at a decoder;

identifying with the decoder a highest priority image data pixel available for inoperative inkjet compensation in the received image data pixels, the identification of the highest priority image data pixel being between a highest priority image data pixel on the first side of the inoperative inkjet and a highest priority image data pixel on the second side of the inoperative inkjet.

8. The method of claim 7 further comprising:

activating the enable signal for each multiplexer selectively with the controller to enable the multiplexers to output the image data pixels in the predetermined order to the decoder.

9. The method of claim 7 further comprising:

identifying a row index and a column index in the image for the highest priority image data pixel with the decoder.

10. The method of claim 7 further comprising:

outputting a first predetermined value from at least one multiplexer in the plurality of multiplexers in response to a second predetermined value being present at the selector port of the at least one multiplexer and the enable signal at the least one multiplexer being active.

11. A method of prioritizing image data pixel locations for inoperative inkjet compensation comprising:

receiving a same plurality of image data pixels in an image at a plurality of inputs at each multiplexer in a plurality of mutliplexers;

operating with a controller a memory having a plurality of storage locations to output data stored in the plurality of storage locations in a first sequence to a selector port of each multiplexer in the plurality of multiplexers;

outputting one of the image data pixels in the plurality of image data pixels at the plurality of inputs of each multiplexer with reference to data provided to the selector port of each multiplexer in response to an enable signal being active at the multiplexer;

receiving the image data pixels output from the plurality of multiplexers in a predetermined order at a decoder;

identifying with the decoder a highest priority image data pixel available for inoperative inkjet compensation in the received image data pixels; and disabling at least one image data pixel output by at least one multiplexer from being identified as the highest priority image data pixel by combining with a logical circuit data output by the plurality of multiplexers with data stored in a second memory.

12. The method of claim 11 further comprising:

storing with the controller data in the second memory with reference to edges detected in the image.

13. The method of claim 11 further comprising:

outputting the image data pixel removed from being identified as the highest priority image data pixel with at least one other multiplexer in the plurality of multiplexers; and storing with the controller data in the second memory that enables the logical circuit to provide the image data pixel removed from being identified as the highest priority image data pixel to the decoder.

* * * * *